US008169393B2

(12) United States Patent
Yasuda et al.

(10) Patent No.: US 8,169,393 B2
(45) Date of Patent: May 1, 2012

(54) DISPLAY DEVICE

(75) Inventors: Kozo Yasuda, Mobara (JP); Katsumi Matsumoto, Mobara (JP); Toshio Miyazawa, Chiba (JP)

(73) Assignees: Hitachi Displays, Ltd., Chiba-Ken (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 1141 days.

(21) Appl. No.: 12/007,937

(22) Filed: Jan. 17, 2008

(65) Prior Publication Data

US 2008/0174538 A1 Jul. 24, 2008

(30) Foreign Application Priority Data

Jan. 24, 2007 (JP) ..... 2007-013673

(51) Int. Cl.
*G09G 3/36* (2006.01)

(52) U.S. Cl. ..... 345/98; 345/89
(58) Field of Classification Search ..... 345/89, 345/98, 6
See application file for complete search history.

(56) References Cited

U.S. PATENT DOCUMENTS

| | | | | |
|---|---|---|---|---|
| 5,689,280 | A * | 11/1997 | Asari et al. | 345/89 |
| 6,989,824 | B1 | 1/2006 | Ishii et al. | |
| 2004/0189581 | A1* | 9/2004 | Sako et al. | 345/98 |
| 2006/0017653 | A1* | 1/2006 | Tsao | 345/6 |
| 2006/0221033 | A1 | 10/2006 | Yasuda et al. | |

FOREIGN PATENT DOCUMENTS

JP 2003-108031 9/2001

* cited by examiner

*Primary Examiner* — Quan-Zhen Wang
*Assistant Examiner* — Tony Davis
(74) *Attorney, Agent, or Firm* — Stites & Harbison, PLLC; Juan Carlos A. Marquez, Esq.

(57) ABSTRACT

A display device includes a display panel having (m×n) pieces of pixels wherein m and n are integers of 2 or more, n pieces of video lines, and m pieces of scanning lines, a video line address circuit, a scanning line address circuit, n pieces of video line vector circuits which are connected to the respective output terminals of the video line address circuit and input the same video data to the pixels at address positions from a starting address to an ending address at one time, and m pieces of scanning line vector circuits which are connected to the respective output terminals of the scanning line address circuits and input the selective scanning voltages to the pixels at the address positions from the starting address to the ending address at one time.

15 Claims, 5 Drawing Sheets

DISPLAY DEVICE

The present application claims priority from Japanese applications JP2007-13673 filed on Jan. 24, 2007, the content of which is hereby incorporated by reference into this application.

BACKGROUND OF THE INVENTION

The present invention relates to a display device such as a liquid crystal display device or an EL display device, and more particularly to a display device which arranges memories for respective display pixels.

There has been known a highly functional liquid crystal display device which arranges memory parts in respective display pixels in the inside of a liquid crystal display panel, and stores display data in the memory parts thus displaying an image on a liquid crystal display panel with small power consumption even when there is no input signals from the outside (see patent document 1 (JP-A-2003-108031)).

On the other hand, there has been also known a highly functional liquid crystal display device having a memory part in each display pixel which is configured such that an X-address circuit and a Y-address circuit are arranged in the liquid crystal display device, and video data is written in memory parts of display pixels at positions selected by the X-address circuit and the Y-address circuit.

Further, there has been also known a liquid crystal display device which is configured such that the memory parts of the respective display pixels, the X-address circuit and the Y-address circuit which are described above are constituted of thin film transistors each of which uses poly-silicon as a material of a semiconductor layer (herein after referred to as Poly-Si TFTs) and, the X-address circuit and the Y-address circuit are integrally formed on a substrate on which the memory parts of the respective display pixels of a liquid crystal display panel are also formed.

SUMMARY OF THE INVENTION

In a liquid crystal display device which arranges a memory part in each display pixel of a liquid crystal display panel, an X-address circuit and a Y-address circuit are arranged. In writing video data in the memory part of the display pixel at a position selected by the X-address circuit and the Y-address circuit, as a method for performing address setting, there has been known a method which directly sets an address in the X-address circuit and the Y-address circuit from the outside or a method which forms a X-address register and a Y-address register in the X-address circuit and the Y-address circuit and indirectly sets an address in the registers from a central processing unit (CPU). In this case, it is necessary to set all addresses of positions to which video data is written.

On the other hand, when the X-address circuit and the Y-address circuit are constituted of a poly-silicon TFT, an operational speed of the Poly-Si TFT is not so high and hence, a writing speed of video data cannot be increased remarkably thus giving rise to a drawback that a drawing speed of a figure cannot be increased.

The present invention has been made to overcome the above-mentioned drawbacks of the related art, and it is an object of the present invention to provide a technique which can increase a drawing speed of a figure in a display device which arranges a memory part for every display pixel.

The above-mentioned and other objects and novel features of the present invention will become apparent from the description of this specification and attached drawings.

To simply explain the summary of typical inventions among inventions disclosed in this specification, they are as follows.

(1) In a display device which includes: a display panel having (m×n) pieces of display pixels wherein m and n are integers of 2 or more, n pieces of video lines which input video data to the respective display pixels, and m pieces of scanning lines which input selective scanning voltages to the respective display pixels; a video line address circuit which includes n pieces of output terminals and supplies the video data to the respective video lines; a scanning line address circuit which includes m pieces of output terminals and supplies the selective scanning voltage to the respective scanning lines, the display device further includes at least one of n pieces of video line vector circuits which are connected to the respective output terminals of the video line address circuit and input the same video data to the display pixels at address positions from a starting address to an ending address at one time, and m pieces of scanning line vector circuits which are connected to the respective output terminals of the scanning line address circuits and input the selective scanning voltages to the display pixels at the address positions from the starting address to the ending address at one time.

(2) In the display device having the constitution (1), the display device further includes data lines to which video data is supplied and n pieces of switching elements which are connected between the data lines and the respective video lines, and are turned on and off in response to output voltages from the video line vector circuits.

(3) In the display device having the constitution (1) or (2), a voltage at a first voltage level is inputted to the first video line vector circuit, an output voltage of the (j−1)th video line vector circuit is inputted to the j (2≦j≦n)th video line vector circuit, an output voltage of the video line vector circuit at the address position from the starting address to the ending address is a voltage at a second voltage level which differs from the first voltage level, and an output voltage of the video line vector circuit at an address position before the starting address and an address position after the ending address is a voltage at the first voltage level.

(4) In the display device having the constitution (3), each video line vector circuit includes a first D-type flip-flop circuit having a D terminal to which an output voltage from a corresponding output terminal of the video line address circuit is inputted and a clock terminal to which an address acquisition clock is inputted, a second D-type flip-flop circuit having a D terminal to which a voltage at a first voltage level or a second voltage level is inputted and a clock terminal to which an output voltage from a Q terminal of the first D-type flip-flop circuit is inputted, an inverter which inverts the output voltage from the Q terminal of the first D-type flip-flop circuit, a first clocked buffer having a clock terminal to which an output voltage of the inverter is inputted, and a second clocked buffer having a clock terminal to which the output voltage from the Q terminal of the first D-type flip-flop circuit is inputted and an input terminal to which the output voltage from the Q terminal of the second D-type flip-flop circuit is inputted, an output terminal of each video line vector circuit is connected to an output terminal of the first clocked buffer and an output terminal of the second clocked buffer, a voltage at a first voltage level is inputted to the first clocked buffer of the first video line vector circuit, and an output voltage outputted from an output terminal of the (j−1)th video line vector circuit is inputted to the first clocked buffer of the jth video line vector circuit.

(5) In the display device having the constitution (4), in the video line vector circuit at the starting address position, the voltage at a second voltage level is inputted to the D terminal of the second D-type flip-flop circuit, an output of the first clocked buffer assumes high impedance, and an output of the second clocked buffer assumes the voltage at a second voltage level, and in the video line vector circuit at the ending address position, a voltage at a first voltage level is inputted to the D terminal of the second D-type flip-flop circuit, an output of the first clocked buffer assumes high impedance, and an output of the second clocked buffer assumes the voltage at a first voltage level.

(6) In the display device having the constitution (1) or (2), a non-selective scanning voltage is inputted to the first scanning line vector circuit, an output voltage of the (k−1)th scanning line vector circuit is inputted to the k(2≦k≦n)th scanning line vector circuit, an output voltage of the scanning line vector circuit at the address position from the starting address to the ending address is a selective scanning voltage, and an output voltage of the scanning line vector circuit at an address position before the starting address and an address position after the ending address is a non-selective scanning voltage.

(7) In the display device having the constitution (6), each scanning line vector circuit includes a first D-type flip-flop circuit having a D terminal to which an output voltage from a corresponding output terminal of the scanning line address circuit is inputted and a clock terminal to which an address acquisition clock is inputted, a second D-type flip-flop circuit having a D terminal to which a voltage at a first voltage level or a second voltage level is inputted and a clock terminal to which an output voltage from a Q terminal of the first D-type flip-flop circuit is inputted, an inverter which inverts the output voltage from the Q terminal of the first D-type flip-flop circuit, a first clocked buffer having a clock terminal to which an output voltage of the inverter is inputted, and a second clocked buffer having a clock terminal to which the output voltage from the Q terminal of the first D-type flip-flop circuit is inputted and an input terminal to which the output voltage from the Q terminal of the second D-type flip-flop circuit is inputted, an output terminal of each scanning line vector circuit is connected to an output terminal of the first clocked buffer and an output terminal of the second clocked buffer, a non-selective scanning voltage is inputted to the first clocked buffer of the first scanning line vector circuit, and an output voltage outputted from an output terminal of the (k−1)th scanning line vector circuit is inputted to the first clocked buffer of the kth scanning line vector circuit.

(8) In the display device having the constitution (7), in the scanning line vector circuit at the starting address position, a selective scanning voltage is inputted to the D terminal of the second D-type flip-flop circuit, an output of the first clocked buffer assumes high impedance, and an output of the second clocked buffer assumes the selective scanning voltage, and in the scanning line vector circuit at the ending address position, the non-selective scanning voltage is inputted to the D terminal of the second D-type flip-flop circuit, an output of the first clocked buffer assumes high impedance, and an output of the second clocked buffer assumes the non-selective scanning voltage.

(9) In the display device having any one of the constitutions (1) to (8), each display pixel includes a memory part which stores video data therein, a pixel electrode, and a switching portion which selectively applies a first video voltage or a second video voltage which differs from the first video voltage to the pixel electrode in response to the video data stored in the memory part.

(10) In the display device having the constitution (9), the display device includes common electrodes which face the pixel electrodes in an opposed manner, and the first video voltage is applied to the common electrodes.

(11) In the display device having the constitution (9) or (10), the respective address circuits are integrally formed on the same substrate of the display panel on which the memory parts are formed.

(12) In the display device having any one of the constitutions (1) to (11), the display device is a liquid crystal display device.

To briefly explain advantageous effects obtained by typical inventions among the inventions disclosed in this specification, they are as follows.

According to the present invention, the display device which arranges memory parts in respective display pixels can increase a drawing speed of a figure.

DESCRIPTION OF THE PREFERRED EMBODIMENTS

Hereinafter, embodiments in which the present invention is applied to a liquid crystal display device are explained in detail in conjunction with drawings.

Here, in all drawings for explaining the embodiments, parts having same functions are given same symbols and their repeated explanation is omitted.

[Liquid Crystal Display Device which Becomes the Presumption of the Present Invention]

Figure 1:
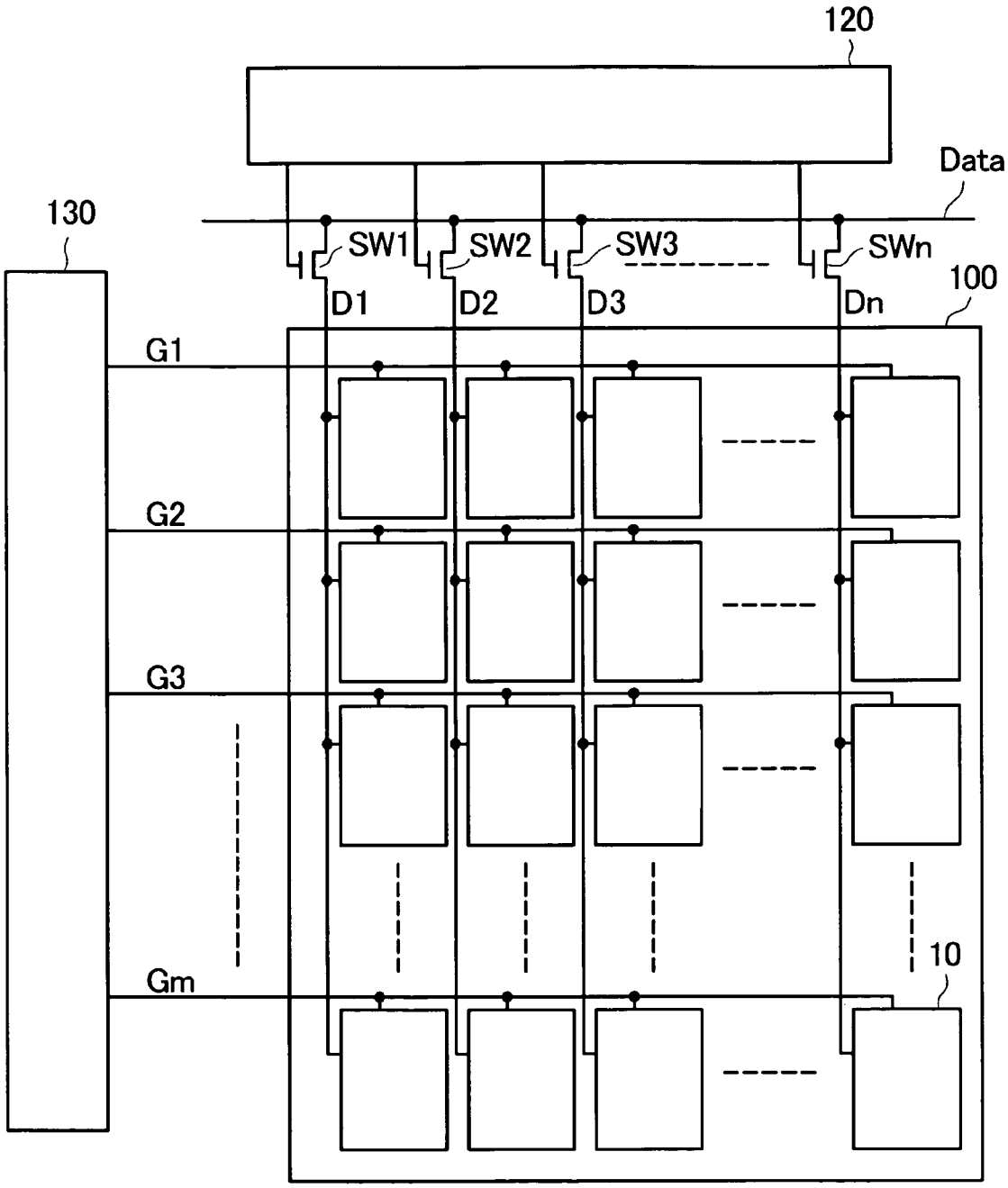
FIG. 1 PRIOR ART
FIG. 1 is a block diagram showing the schematic constitution of a liquid crystal display device which becomes a presumption of the present invention.

FIG. 1 is a block diagram showing the schematic constitution of the liquid crystal display device which becomes the presumption of the present invention. In FIG. 1, numeral 100 indicates a display part, numeral 120 indicates an X-address circuit (also referred to as a video line address circuit), numeral 130 indicates a Y-address circuit (also referred to as a scanning line address circuit), and numeral 10 indicates display pixels.

The display part 100 includes a plurality of display pixels 10 which are arranged in a matrix array, video lines (also referred to as drain lines) (D1, D2, D3, . . . , Dn) which supply display data to the respective display pixels 10, and scanning lines (also referred to as gate lines) (G1, G2, G3, . . . , Gm) which supply scanning signals to the respective display pixels 10.

The X-address circuit 120 includes n pieces of output terminals, and the respective output terminals of the X-address circuit 120 are connected to gates of thin film transistors which constitutes switching elements (SW1, SW2, SW3, . . . , SWn).

In writing video data to the display pixel 10 at a selected position, the X-address circuit 120 turns on the switching element SW corresponding to the display pixel 10 at the selected position among the switching elements (SW1, SW2, SW3, . . . , SWn) so that the video data is supplied to the video line corresponding to the display pixel 10 at the selected position out of the video lines (D1, D2, D3, . . . , Dn) from the data line (Data) to which the video data is supplied.

In the same manner, the Y-address circuit 130 supplies a selective scanning voltage to the scanning line corresponding to the display pixel 10 at the selected position out of the scanning lines (G1, G2, G3, . . . , Gm).

Figure 2:
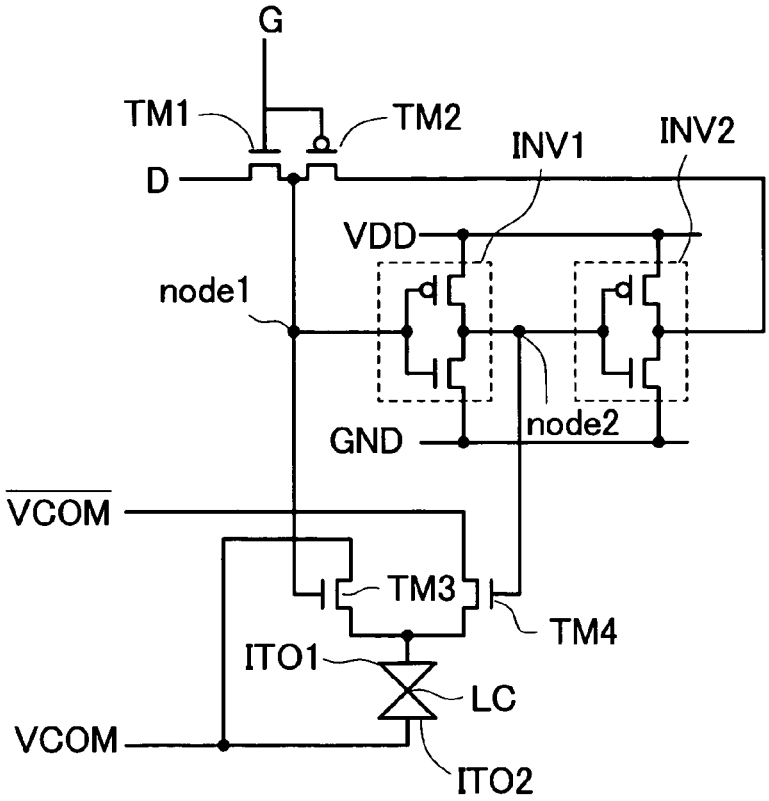
FIG. 2 PRIOR ART
FIG. 2 is a circuit diagram showing an equivalent circuit of a display pixel shown in FIG. 1.

FIG. 2 is a circuit diagram showing an equivalent circuit of the display pixel 10 shown in FIG. 1. In the drawing, a first inverter circuit (INV1) and a second inverter circuit (INV2) constitute a memory part.

The first inverter circuit (INV1) has an input terminal thereof connected to a node 1 (node1) and an output terminal thereof connected to a node 2 (node2). Further, the second inverter circuit (INV2) has an input terminal thereof connected to the node 2 (node1) and an output terminal thereof connected to the node 1 (node2).

Here, although the output terminal of the second inverter circuit (INV2) is connected to the input terminal of the first inverter circuit (INV1) via a p-type transistor (TM2), the p-type transistor (TM2) is turned on in a usual state, that is, when the memory part is in a holding operation state.

Accordingly, the output terminal of the second inverter circuit (INV2) and the input terminal of the first inverter circuit (INV1) may be directly connected with each other by omitting the p-type transistor (TM2).

A drain of an n-type transistor (TM1) and a drain of the p-type transistor (TM2) are connected to the node 1 (node1), and a gate of the n-type transistor (TM1) and a gate of the p-type transistor (TM2) are connected to the scanning line (G).

Accordingly, when a selective scanning voltage of high level (herein after referred to as H level), for example, is applied to the scanning line (G), the n-type transistor (TM1) is turned on and the p-type transistor (TM2) is turned off so that the video data ("1" or "0") applied to the video line (D) is written in the node 1 (node1). That is, the video data writing operation is performed.

Further, when a non-selective scanning voltage of low level (herein after referred to as L level), for example, is applied to the scanning line (G), the n-type transistor (TM1) is turned off and the p-type transistor (TM2) is turned on so that a data value written in the node 1 (node1) is held in the memory part constituted of the first inverter circuit (INV1) and the second inverter circuit (INV2). That is, a holding operation is performed.

An n-type transistor (TM3) which has a gate thereof connected to the node 1 (node1) is turned on when the voltage of the node 1 (node1) assumes an H level so that a first video voltage (here, a voltage VCOM which is applied to a common electrode (ITO2)) is applied to a pixel electrode (ITO1).

An n-type transistor (TM4) which has a gate thereof connected to the node 2 (node2) is turned on when the voltage of the node 2 (node2) assumes an H level so that a second video voltage (here, a voltage bar-VCOM which is acquired by inverting the voltage VCOM by the inverter and is applied to the common electrode (ITO2)) is applied to the pixel electrode (ITO1).

The relationship between the node 1 (node1) and the node 2 (node2) is set such that signal levels of these nodes are inverted from each other. Accordingly, when the voltage of the node 1 (node1) assumes an H level, the voltage of the node 2 (node2) assumes an L level and hence, the n-type transistor (TM3) is turned on and the n-type transistor (TM4) is turned off. When the voltage of the node 1 (node1) assumes an L level, the voltage of the node 2 (node2) assumes an H level and hence, the n-type transistor (TM3) is turned off and the n-type transistor (TM4) is turned on.

In such a manner, a switching portion (constituted of two transistors (TM3, TM4) of the same conductive type, for example) selects and applies the first video voltage or a second video voltage to the pixel electrode (ITO1) in response to data stored in the memory part (data written in the memory part from the video line (D)).

Liquid crystal (LC) is driven by an electric field generated between the pixel electrode (ITO1) and the common electrode (also referred to as counter electrode (ITO2)) arranged to face the pixel electrode (ITO1) in an opposed manner. Here, the common electrode (ITO2) may be formed on the same substrate on which the pixel electrode (ITO1) is formed or may be formed on a substrate different from the substrate on which the pixel electrode (ITO1) is formed.

Transistors which constitute the inverter circuits (INV1, INV2) and transistors (TM1, TM2, TM3, TM4) are formed of a thin film transistor which uses poly-silicon as a material of a semiconductor layer.

The X-address circuit 120 and the Y-address circuit 130 in FIG. 1 are circuits which are arranged in the inside of a liquid crystal display panel. These circuits are respectively constituted of thin film transistors each of which uses poly-silicon as a material of a semiconductor layer in the same manner as the transistors which constitutes the inverter circuits (INV1, INV2) and the transistors (TM1, TM2, TM3, TM4). These thin film transistors are simultaneously formed with the transistors which constitutes the inverter circuits (INV1, INV2).

Further, when the non-selective scanning voltage is applied to the scanning line (G), the transistor (TM1) is turned off and the transistor (TM2) is turned on so that a data value written in the node 1 (node1) is held in the memory part constituted of the first inverter circuit (INV1) and the second inverter circuit (INV2). Accordingly, an image is displayed on the display part 100 even during a period in which there is no image inputting.

For example, in case of a normally white liquid crystal display panel, when "1" is written in the node 1 (node1) ("0" being written in the node 2 (node2)), the liquid crystal display panel performs a "white" display, while when "0" is written in the node 1 (node1) ("1" being written in the node 2 (node2)), the liquid crystal display panel performs a "black" display.

When it is unnecessary to rewrite an image, it is possible to stop operations of the X-address circuit 120 and the Y-address circuit 130 and hence, the consumption of power can be reduced.

Figure 3:
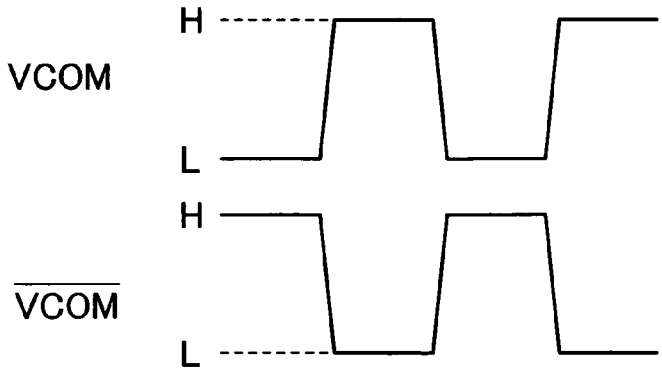
FIG. 3 PRIOR ART
FIG. 3 is a view for explaining an inverting cycle of a voltage VCOM and a voltage bar-VCOM shown in FIG. 2.

FIG. 3 is a view for explaining an inversion cycle of the voltage VCOM and the voltage bar-VCOM which is acquired by inverting the voltage VCOM shown in FIG. 2.

Although a common inversion drive method is adopted as an AC drive method of the liquid crystal display device shown in FIG. 1, in the liquid crystal display device shown in FIG. 1, as shown in FIG. 3, it is sufficient to change the voltage VCOM (first video voltage) and the voltage bar-VCOM (second video voltage) which is acquired by inverting the voltage VCOM in response to the common inversion cycle. The voltage VCOM is inverted between an L level (for example, 0V) and an H level (for example, 5V) in response to the common inversion cycle. The voltage bar-VCOM can be generated by inverting the voltage VCOM using the inverter. When the voltage VCOM assumes an L level, the voltage bar-VCOM assumes an H level, while when the voltage VCOM assumes an H level, the voltage bar-VCOM assumes an L level. That is, a magnitude of the voltage VCOM and a magnitude of the voltage bar-VOCM are changed over at a predetermined cycle.

EMBODIMENT

Figure 4:
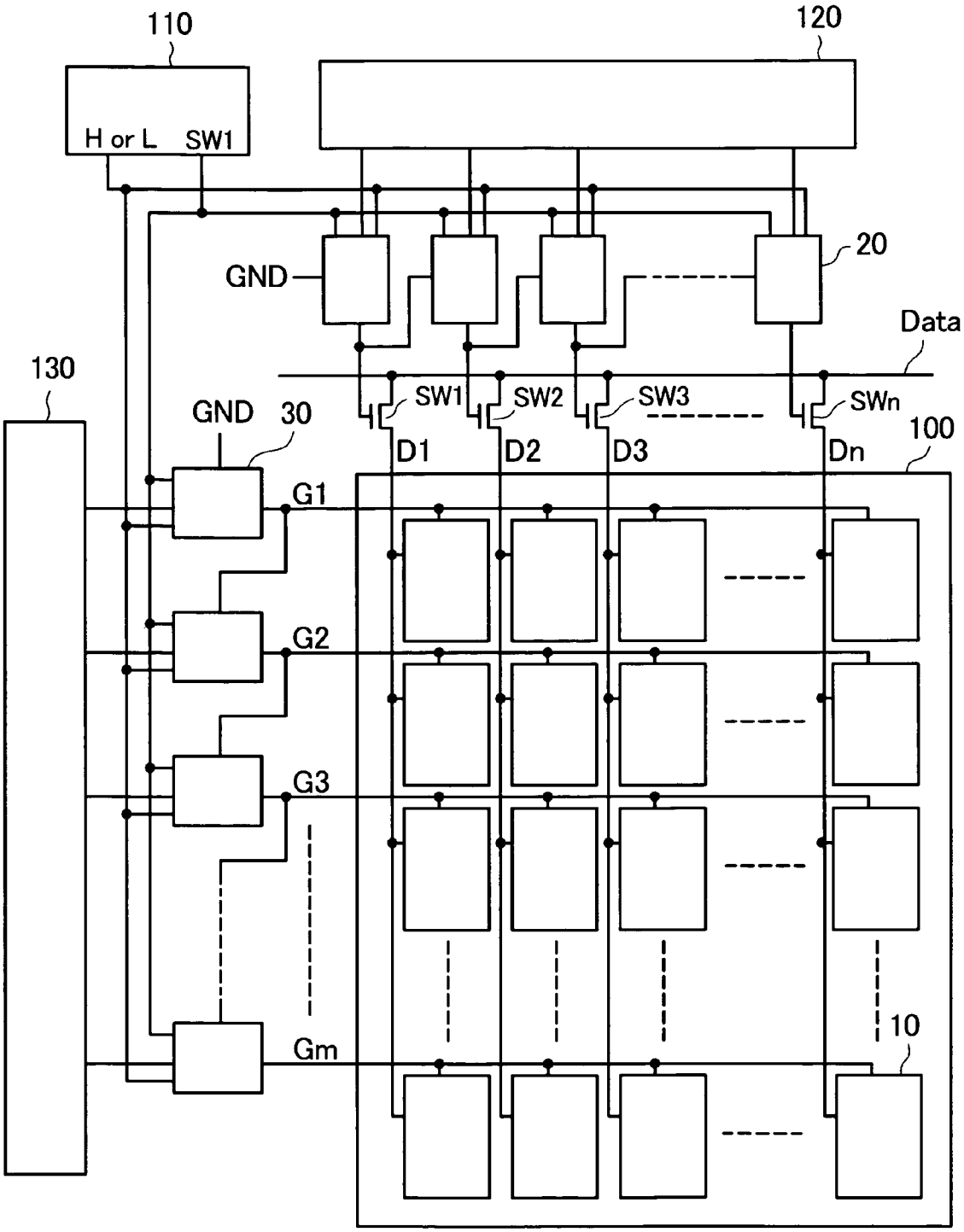
FIG. 4 is a block diagram showing the schematic constitution of a liquid crystal display device of an embodiment of the present invention.

FIG. 4 is a block diagram showing the schematic constitution of a liquid crystal display device of an embodiment of the present invention.

In FIG. 4, numeral 100 indicates a display part, numeral 110 indicates a display control circuit, numeral 120 indicates an X-address circuit, numeral 130 indicates a Y-address circuit, numeral 10 indicates display pixels, numeral 20 indicates video line vector circuits, and numeral 30 indicates scanning line vector circuits.

The liquid crystal display device of this embodiment differs from the liquid crystal display device shown in FIG. 1 with respect to the point that the liquid crystal display device of this embodiment includes the video line vector circuits 20 and the scanning line-vector circuits 30.

The video line vector circuits 20 of this embodiment are circuits provided for designating a starting address and an ending address of X-addresses and for writing the same video data in memory parts of all display pixels 10 at an address position between the starting address and the ending address at one time. Due to the provision of the video line vector circuit 20, lateral lines can be drawn.

Further, the scanning line vector circuits 30 of this embodiment are circuits provided for designating a starting address and an ending address of Y-addresses and for writing the same video data in memory parts of all display pixels 10 at an address position between the starting address and the ending address at one time. Due to the provision of the scanning line vector circuit 30, longitudinal lines can be drawn.

Still further, by designating the starting address and the ending address in both of the X-address circuit 120 and the Y-address circuit 130, it is possible to draw a quadrangular shape. This embodiment is effectively applicable in producing display data having high correlation between pixels or in drawing animations.

Figure 5:
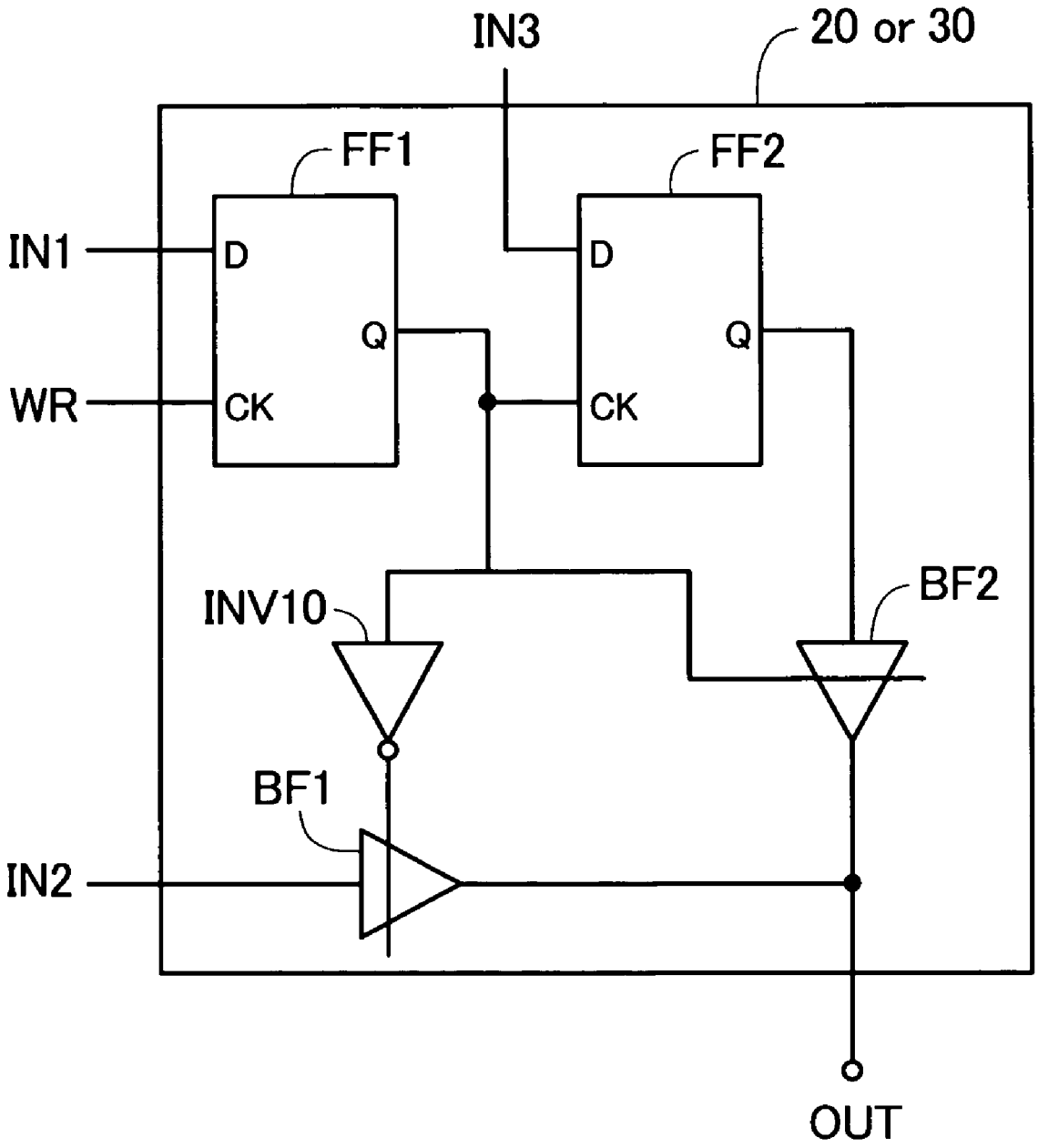
FIG. 5 is a circuit diagram showing one example of circuit constitutions of a video line vector circuit and a scanning line vector circuit shown in FIG. 4.

FIG. 5 is a circuit diagram showing one example of circuit constitutions of the video line vector circuit 20 and the scanning line vector circuit 30 shown in FIG. 4.

With respect to the vector circuit shown in FIG. 5, the video line vector circuit 20 or the scanning line vector circuit 30 is constituted of a first D-type flip-flop circuit (FF1), a second D-type flip-flop circuit (FF2), an inverter (INV10), a first clocked buffer (BF1) and a second clocked buffer (BF2). An address acquisition clock (WR) outputted from a display control circuit 110 is inputted to a clock terminal (CK) of the first D-type flip-flop circuit (FF1). Further, an input signal (IN1) inputted to a D terminal of the first D-type flip-flop circuit (FF1) is an output voltage outputted from a corresponding output terminal of the X-address circuit 120 or the Y-address circuit 130.

An output voltage from a Q terminal of the first D-type flip-flop circuit (FF1) is inputted to a clock terminal (CK) of the second D-type flip-flop circuit (FF2). An input signal (IN3) inputted to a D terminal of the second D-type flip-flop circuit (FF2) is a voltage of H level or L level outputted from the display control circuit 110.

Further, the inverter (INV10) inverts the output voltage from the Q terminal of the first D-type flip-flop circuit (FF1), and an output voltage of the inverter (INV10) is inputted to a clock terminal of the first clocked buffer (BF1).

An input signal (IN2) inputted to the first clocked buffer (BF1) is a voltage of L level (GND) or an output voltage of the video line vector circuit 20 or the scanning line vector circuit 30 on a preceding stage.

To the second clocked buffer (BF2) which allows inputting of an output voltage from the Q terminal of the first D-type flip-flop circuit (FF1) to a clock terminal thereof, an output voltage from the Q terminal of the second D-type flip-flop circuit (FF2) is inputted.

Further, an output terminal of the first clocked buffer (BF1) and an output terminal of the second clocked buffer (BF2) are connected to an output terminal of each video line vector circuit.

Figure 6A:
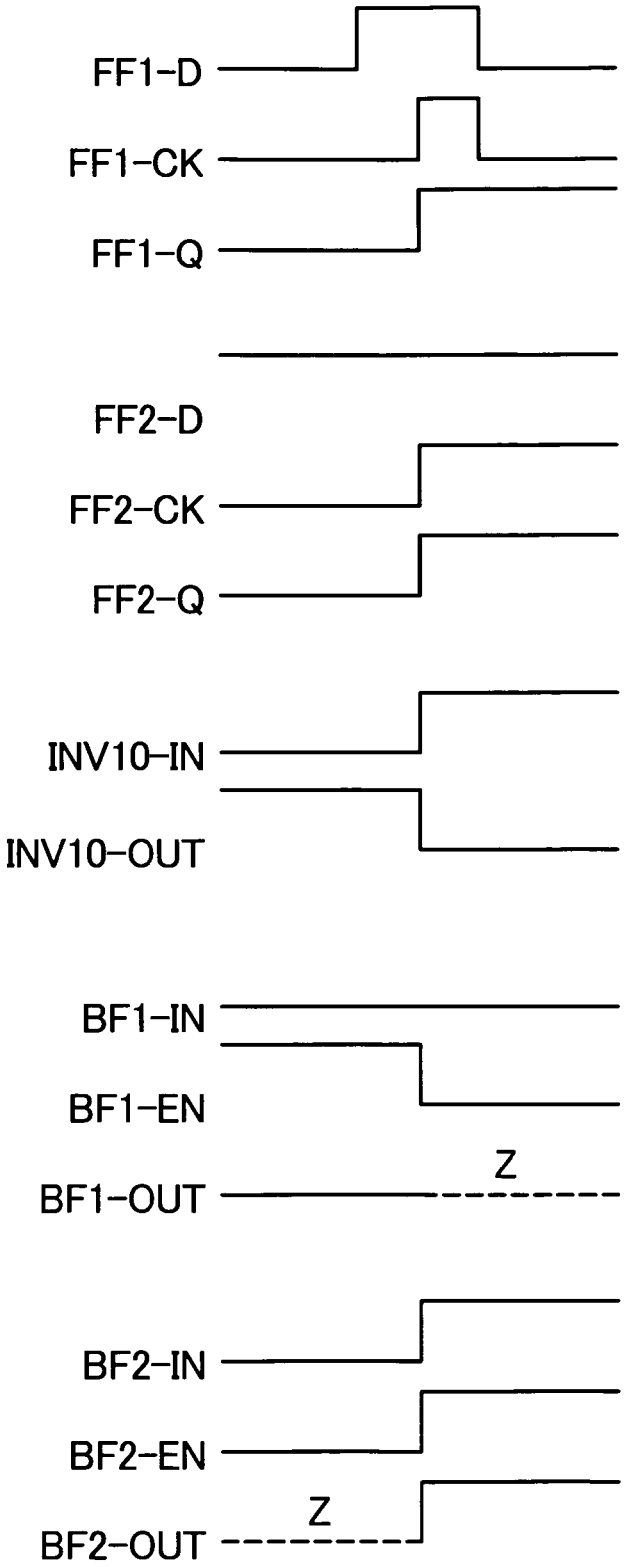
FIG. 6 is a timing chart of the vector circuit shown in FIG. 5.
Figure 6B:
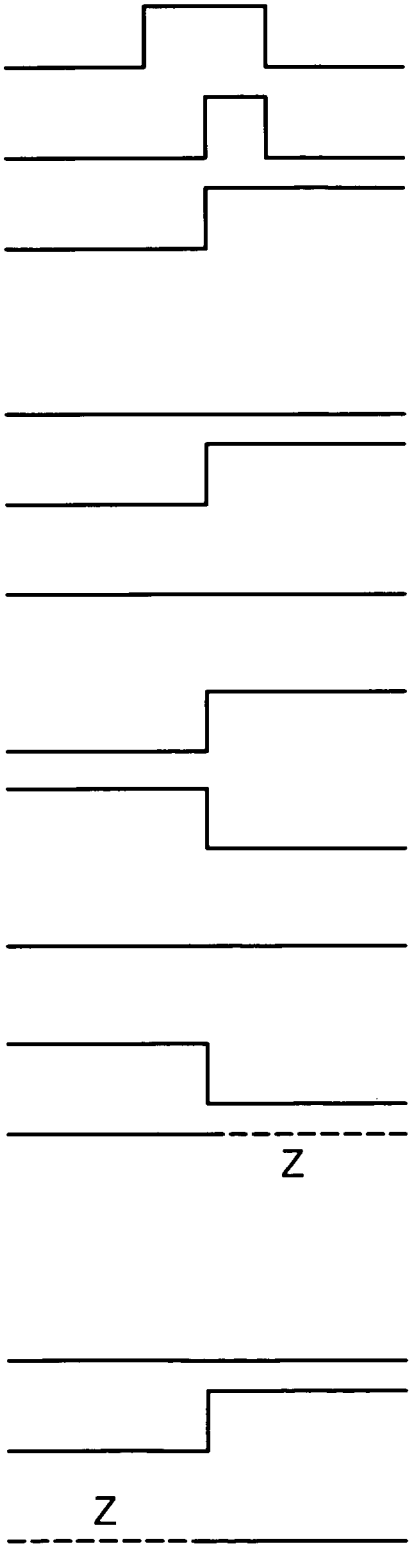

FIG. 6 is a timing chart of the vector circuit shown in FIG. 5.

Hereinafter, the manner of operation of the vector circuit shown in FIG. 5 is explained in conjunction with FIG. 6.

When an address is not selected, outputs of the Q terminals of the first D-type flip-flop circuit (FF1) and the second D-type flip-flop circuit (FF2) are at a voltage of L level. Here, the output of the Q terminal of the first D-type flip-flop circuit (FF1) is inverted by the inverter (INV10) to assume an H level and is inputted to the clock terminal of the first clocked buffer (BF1) and hence, the first clocked buffer (BF1) is turned on and the output of the clocked buffer (BF1) assumes a voltage of L level.

Further, the output of L level at the Q terminal of the first D-type flip-flop circuit (FF1) is inputted to the clock terminal of the second clocked buffer (BF2) and hence, an output of the second clocked buffer (BF2) assumes high impedance (Z).

Accordingly, all lateral lines assume a voltage of L level and hence, no address is selected.

Next, when the starting address is inputted, to the D terminal of the first D-type flip-flop circuit (FF1) in the video line vector circuit 20 at the starting address position, a voltage of H level is inputted from the X-address circuit 120 (FF1-D in FIG. 6(*a*)).

When an address acquisition clock (WR) is inputted to the first D-type flip-flop circuit (FF1) from the display control circuit 110 (FF1-CK in FIG. 6(*a*)), an output of the Q terminal of the first D-type flip-flop circuit (FF1) assumes a voltage of H level (FF1-Q in FIG. 6(*a*)) and hence, the first clocked buffer (BF1) is turned off and an output of the first clocked buffer (BF1) assumes high impedance (Z) (BF1-OUT in FIG. 6(*a*)).

Further, although the second clocked buffer (BF2) is turned on, at this point of time, a voltage of H level is inputted to the D terminal of the second D-type flip-flop circuit (FF2) from the display control circuit 110 (FF2-D in FIG. 6(*a*)).

Accordingly, when an output of Q terminal of the first D-type flip-flop circuit (FF1) assumes a voltage of H level, an output of the Q terminal of the second D-type flip-flop circuit (FF2) assumes a voltage of H level (FF2-Q in FIG. 6(*a*)).

As a result, an output of the clocked buffer (BF2) assumes a voltage of H level (BF2-OUT in FIG. 6(*a*)) and hence, the succeeding lines assume a voltage of H level.

Next, when the ending address is inputted, to the D terminal of the first D-type flip-flop circuit (FF1) in the inside of the video line vector circuit 20 at the ending address position, a voltage of H level is inputted from the X-address circuit 120 (FF1-D in FIG. 6(*b*)).

When an address acquisition clock (WR) is inputted to the first D-type flip-flop circuit (FF1) from the display control circuit 110 (FF1-CK in FIG. 6(*b*)), an output of the Q terminal of the first D-type flip-flop circuit (FF1) assumes a voltage of H level (FF1-Q in FIG. 6(*b*)) and hence, the first clocked buffer (BF1) is turned off and an output of the first clocked buffer (BF1) assumes high impedance (Z) (BF1-OUT in FIG. 6(*b*)).

Further, although the second clocked buffer (BF1) is turned on, at this point of time, a voltage of L level is inputted to the D terminal of the second D-type flip-flop circuit (FF2) from the display control circuit 110 (FF2-D in FIG. 6(*a*)).

Accordingly, even when an output of Q terminal of the first D-type flip-flop circuit (FF1) assumes a voltage of H level, an output of the Q terminal of the second D-type flip-flop circuit (FF2) is held at the voltage of L level (FF2-Q in FIG. 6(*b*)).

When the output of the Q terminal of the first D-type flip-flop circuit (FF1) assumes the voltage of H level and the second clocked buffer (BF2) is turned on in this manner, an output of the clocked buffer (BF2) assumes a voltage of L level (BF2-OUT in FIG. 6(*b*)) and succeeding lines assume a voltage of L level.

That is, all display pixels 10 at address positions from the starting address to the ending address are selected. By inputting display data from the data lines (Data) in such a state, the lateral lines can be drawn using the X-address, the longitudinal lines can be drawn using the Y-address, and a quadrangular shape can be drawn using both of the X-address and the Y-address.

In the above-mentioned embodiment, the explanation has been made with respect to the case in which the present invention is applied to the liquid crystal display device. However, it is needless to say that the present invention is not limited to such a liquid crystal display device, and the present invention is applicable to other display device such as an EL display device (including an organic EL display device).

Further, in the above-mentioned embodiment, the explanation has been made with respect to the case in which the peripheral circuit (for example, the X-address circuit 120 or the Y-address circuit 130) is incorporated in the inside of the liquid crystal display panel (integrally formed on the substrate of the liquid crystal display panel). However, the present invention is not limited to such a constitution and some functions of the peripheral circuit may be constituted of a semiconductor chip.

Still further, in the above-mentioned embodiment, the explanation has been made with respect to the case in which a MOS transistor is used as the thin film transistor. However, an MIS transistor which is more conceptual than the MOS transistor may be used.

Although the invention made by inventors of the present invention has been specifically explained in conjunction with the embodiment heretofore, it is needless to say that the present invention is not limited to the above-mentioned embodiment and various modifications are conceivable without departing from the gist of the present invention.

What is claimed is:

1. A display device comprising:

a display panel having (m×n) pieces of display pixels wherein m and n are integers of 2 or more, n pieces of video lines which input video data to the respective display pixels, and m pieces of scanning lines which input selective scanning voltages to the respective display pixels;

a video line address circuit which includes n pieces of output terminals and supplies the video data to the respective video lines;

a scanning line address circuit which includes m pieces of output terminals and supplies the selective scanning voltage to the respective scanning lines;

n pieces of video line vector circuits each of which is respectively connected to a corresponding output terminal of the video line address circuit, the n pieces of video line vector circuits inputting the same video data to the display pixels at address positions from a starting address to an ending address at one time; and m pieces of scanning line vector circuits each of which is respectively connected to a corresponding output terminal of the scanning line address circuit, the m pieces of scanning line vector circuits inputting the selective scanning voltages to the display pixels at the address positions from the starting address to the ending address at one time, and wherein a voltage at a first voltage level is inputted to a first video line vector circuit, an output voltage of each (j−1)th video line vector circuit is inputted to the j(2≦j≦n)th video line vector circuit, an output voltage of each video line vector circuit at an address position from the starting address to the ending address is a voltage at a second voltage level which differs from the first voltage level, and an output voltage of each video line vector circuit at an address position before the starting address and an address position after the ending address is a voltage at the first voltage level, each video line vector circuit includes the first D-type flip-flop circuit having a D terminal to which an output voltage from a corresponding output terminal of the video line address circuit is inputted and a clock terminal to which an address acquisition clock is inputted, a second D-type flip-flop circuit having a D terminal to which a voltage at the first voltage level or the second voltage level is inputted and a clock terminal to which an output voltage from a Q terminal of the first D-type flip-flop circuit is inputted, an inverter which inverts the output voltage from the Q terminal of the first D-type flip-flop circuit, a first clocked buffer having a clock terminal to which an output voltage of the inverter is inputted, a second clocked buffer having a clock terminal to which the output voltage from the Q terminal of the first D-type flip-flop circuit is inputted and an input terminal to which the output voltage from the Q terminal of the second D-type flip-flop circuit is inputted, an output terminal of each video line vector circuit is connected to an output terminal of the first clocked buffer and an output terminal of the second clocked buffer, a voltage at the first voltage level is inputted to the first clocked buffer of the first video line vector circuit, and an output voltage outputted from an output terminal of each (j−1) th video line vector circuit is inputted to the first clocked buffer of the jth video line vector circuit.

2. A display device according to claim 1, wherein the display device further includes data lines to which video data is supplied and n pieces of switching elements which are connected between the data lines and the respective video lines, and are turned on and off in response to output voltages from the video line vector circuits.

3. A display device according to claim 1, wherein in the video line vector circuit at the starting address position, the voltage at the second voltage level is inputted to the D terminal of the second D-type flip-flop circuit, an output of the first clocked buffer assumes high impedance, and an output of the second clocked buffer assumes the voltage at the second voltage level, and in the video line vector circuit at the ending address position, a voltage at the first voltage level is inputted to the D terminal of the second D-type flip-flop circuit, the output of the first clocked buffer assumes high impedance, and the output of the second clocked buffer assumes the voltage at a first voltage level.

4. A display device according to claim 1, wherein a non-selective scanning voltage is inputted to a first scanning line vector circuit, an output voltage of each (k−1)th scanning line vector circuit is inputted to the k(2≦k≦n)th scanning line vector circuit, an output voltage of each scanning line vector circuit at an address position from the starting address to the ending address is a selective scanning voltage, and an output voltage of each scanning line vector circuit at an address position before the starting address and an address position after the ending address is a non-selective scanning voltage.

5. A display device according to claim 1, wherein each display pixel includes a memory part which stores video data therein, a pixel electrode, and a switching portion which selectively applies a first video voltage or a second video voltage which differs from the first video voltage to the pixel electrode in response to the video data stored in the memory part.

6. A display device according to claim 5, wherein the display device includes common electrodes which face the pixel electrodes in an opposed manner, and the first video voltage is applied to the common electrodes.

7. A display device according to claim 5, wherein the respective address circuits are integrally formed on the same substrate of the display panel on which the memory parts are formed.

8. A display device according to claim 1, wherein the display device is a liquid crystal display device.

9. A display device comprising:

a display panel having (m×n) pieces of display pixels wherein m and n are integers of 2 or more, n pieces of video lines which input video data to the respective display pixels, and m pieces of scanning lines which input selective scanning voltages to the respective display pixels;

a video line address circuit which includes n pieces of output terminals and supplies the video data to the respective video lines;

a scanning line address circuit which includes m pieces of output terminals and supplies the selective scanning voltage to the respective scanning lines;

n pieces of video line vector circuits each of which is respectively connected to a corresponding output terminal of the video line address circuit, the n pieces of video line vector circuits inputting the same video data to the display pixels at address positions from a starting address to an ending address at one time and m pieces of scanning line vector circuits each of which is respectively connected to a corresponding output terminal of the scanning line address circuit, the m pieces of scanning line vector circuits inputting the selective scanning voltages to the display pixels at the address positions from the starting address to the ending address at one time, and wherein a non-selective scanning voltage is inputted to a first scanning line vector circuit, an output voltage of each (k−1)th scanning line vector circuit is inputted to the k(2≦k≦n)th scanning line vector circuit, an output voltage of each scanning line vector circuit at an address position from the starting address to the ending address is a selective scanning voltage, and an output voltage of each scanning line vector circuit at an address position before the starting address and an address position after the ending address is a non-selective scanning voltage, and each scanning line vector circuit includes a first D-type flip-flop circuit having a D terminal to which an output voltage from a corresponding output terminal of the scanning line address circuit is inputted and a clock terminal to which an address acquisition clock is inputted, a second D-type flip-flop circuit having a D terminal to which a voltage at the first voltage level or the second voltage level is inputted and a clock terminal to which an output voltage from a Q terminal of the first D-type flip-flop circuit is inputted, an inverter which inverts the output voltage from the Q terminal of the first D-type flip-flop circuit, a first clocked buffer having a clock terminal to which an output voltage of the inverter is inputted, and a second clocked buffer having a clock terminal to which the output voltage from the Q terminal of the first D-type flip-flop circuit is inputted and an input terminal to which the output voltage from the Q terminal of the second D-type flip-flop circuit is inputted, an output terminal of each scanning line vector circuit is connected to an output terminal of the first clocked buffer and an output terminal of the second clocked buffer, a non-selective scanning voltage is inputted to the first clocked buffer of the first scanning line vector circuit, and an output voltage outputted from an output terminal of each(k−1)th scanning line vector circuit is inputted to the first clocked buffer of the kth scanning line vector circuit.

10. A display device according to claim 9, wherein in the scanning line vector circuit at the starting address position, a selective scanning voltage is inputted to the D terminal of the second D-type flip-flop circuit, an output of the first clocked buffer assumes high impedance, and an output of the second clocked buffer assumes the selective scanning voltage, and in the scanning line vector circuit at the ending address position, the non-selective scanning voltage is inputted to the D terminal of the second D-type flip-flop circuit, the output of the first clocked buffer assumes high impedance, and the output of the second clocked buffer assumes the non-selective scanning voltage.

11. A display device according to claim 9, wherein the display device further includes data lines to which video data is supplied and n pieces of switching elements which are connected between the data lines and the respective video lines, and are turned on and off in response to output voltages from the video line vector circuits.

12. A display device according to claim 9, wherein each display pixel includes a memory part which stores video data therein, a pixel electrode, and a switching portion which selectively applies a first video voltage or a second video voltage which differs from the first video voltage to the pixel electrode in response to the video data stored in the memory part.

13. A display device according to claim 12, wherein the display device includes common electrodes which face the pixel electrodes in an opposed manner, and the first video voltage is applied to the common electrodes.

14. A display device according to claim 12, wherein the respective address circuits are integrally formed on the same substrate of the display panel on which the memory parts are formed.

15. A display device according to claim 9, wherein the display device is a liquid crystal display device.

* * * * *